US006568606B2

(12) United States Patent
Boecking

(10) Patent No.: US 6,568,606 B2
(45) Date of Patent: May 27, 2003

(54) FUEL INJECTION VALVE FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 09/790,584

(22) Filed: Feb. 23, 2001

(65) Prior Publication Data

US 2001/0020648 A1 Sep. 13, 2001

(30) Foreign Application Priority Data

Feb. 24, 2000 (DE) ..... 100 08 554

(51) Int. Cl.[7] ..... F02M 59/00; F02M 61/00; F02M 61/08; F02M 61/20; B05B 1/30

(52) U.S. Cl. ..... 239/533.2; 239/533.3; 239/533.7; 239/533.9; 239/585.3

(58) Field of Search ..... 239/533.2, 533.3, 239/533.7, 533.8, 533.9, 585.1, 585.4, 585.5, 900, 596, 585.3; 251/129.15, 129.21

(56) References Cited

U.S. PATENT DOCUMENTS 5,544,816 A * 8/1996 Nally et al. ..... 239/585.5
5,580,001 A * 12/1996 Romann et al. ..... 239/585.4
5,732,888 A * 3/1998 Maier et al. ..... 239/585.1
5,769,391 A * 6/1998 Noller et al. ..... 251/129.21
5,875,975 A * 3/1999 Reiter et al. ..... 239/858.1
5,915,626 A * 6/1999 Awarzamani et al. ..... 239/135

* cited by examiner

*Primary Examiner*—Michael Mar
*Assistant Examiner*—Davis Hwu
(74) *Attorney, Agent, or Firm*—Ronald E. Greigg

(57) ABSTRACT

Disclosed is a fuel injection valve having at least two valve body parts, which each contact one another at a respective contact face and pressed against one another perpendicular to the contact face by a clamping device. An inflow conduit for fuel formed in both valve body parts passes through the contact faces, and a high fuel pressure prevails in it. At least one radially widened portion is embodied in the inflow conduit, near the contact face of at least one valve body part, so that this radially widened portion, as a result of the fuel pressure in the inflow conduit, undergoes an expansion in the axial direction. As a result, the region of the contact face surrounding the inflow conduit is pressed against the contact face of the contacting valve body part, so that the contact pressure of the contact faces increases, whereby the inflow conduit is thus better sealed off, and the force of the clamping device can be reduced.

16 Claims, 2 Drawing Sheets

FUEL INJECTION VALVE FOR INTERNAL COMBUSTION ENGINES

BACKGROUND OF THE INVENTION

1. Field of the Invention

This invention relates to fuel injection valves and more particularly to an improved fuel system valve for use in an internal combustion engine.

2. Description of the Prior Art

A fuel injection valve of the type with which this invention is concerned is known from International Patent Disclosure PCT 96/02378. This known valve includes a central bore formed in a valve body, and a pistonlike, longitudinally displaceable valve member is disposed in this bore. A valve sealing face is formed on the end of the valve member toward the combustion chamber, and with this face the valve member cooperates with a valve seat, embodied on the end toward the combustion chamber of the central bore, to control at least one injection opening. The valve body is braced in the axial direction against a valve retaining body by a device in the form of a clamping nut.

By means of a taper of the valve member toward the combustion chamber, a pressure shoulder is formed on the valve member; this shoulder is disposed in a pressure chamber, embodied in the valve body, that can be filled with fuel via an inflow conduit extending in the valve body and in the valve retaining body. The inflow conduit passes through the contact face of the valve retaining body and valve body and is sealed off by the contact force of the clamping nut. To achieve an adequate contact pressure in the region of the passage of the inflow conduit and thus to assure secure sealing, the end faces must be ground flat with high precision, which is very complicated and thus expensive.

To increase the tightness, the contact pressure of the valve body at the valve retaining body must be increased. This is desired, however, only in the region of the transition point of the inflow conduit, since if an excessive force is exerted by the clamping nut on the valve body, the result can be deformation of the valve body, which has an unfavorable effect on the guidance of the valve member in the bore of the valve body. With the construction known thus far, it is not possible to increase the contact pressure locally in the region of the transition point of the inflow conduit.

SUMMARY OF THE INVENTION

The fuel injection valve according to the invention has the advantage over the prior art that the hydraulic pressure of the fuel in the inflow conduit is used to increase the contact force of the contact faces of two valve body parts in the region around the passage point of the inflow conduit. By means of a radial widening of the inflow conduit in the vicinity of the contact face of the valve body parts, and as the result of the hydraulic force of the fuel located in the inflow conduit, the radially widened portion is expanded in the axial direction of the inflow conduit. If the valve body parts are the valve body and the valve retaining body, for instance, then the face end, toward the valve body, of the radially widened portion embodied in the valve retaining body is pressed in the direction toward the valve body. This increases the contact pressure of the valve body and the valve retaining body at their contact face in the region of the passage of the inflow conduit and results in better sealing of the inflow conduit and a reduced demand in terms of the quality of the contact faces. It can be provided that a radially widened portion of this kind in the inflow conduit be embodied in both valve body parts contacting one another, or in only one of the two valve body parts.

In an advantageous embodiment of the subject of the invention, the radially widened portion is embodied as an annular groove extending all the way around on the inside wall surface of the inflow conduit. This makes simple, economical production possible and because of the rotationally symmetrical design of the radially widened portion, it assures a uniform contact pressure in the region of the passage of the inflow conduit through the contact face of the valve body parts. Advantageously, the transitional edges of the inflow conduit to the radially widened portion are rounded, so that at these points, no eddies can develop in the fuel flow through the inflow conduit.

BRIEF DESCRIPTION OF THE DRAWINGS

The invention will be better understood and further objects and advantages thereof will become more apparent from the ensuing detailed description of a preferred embodiment taken in conjunction with the drawing, in which.

DESCRIPTION OF THE PREFERRED EMBODIMENT

Figure 1:
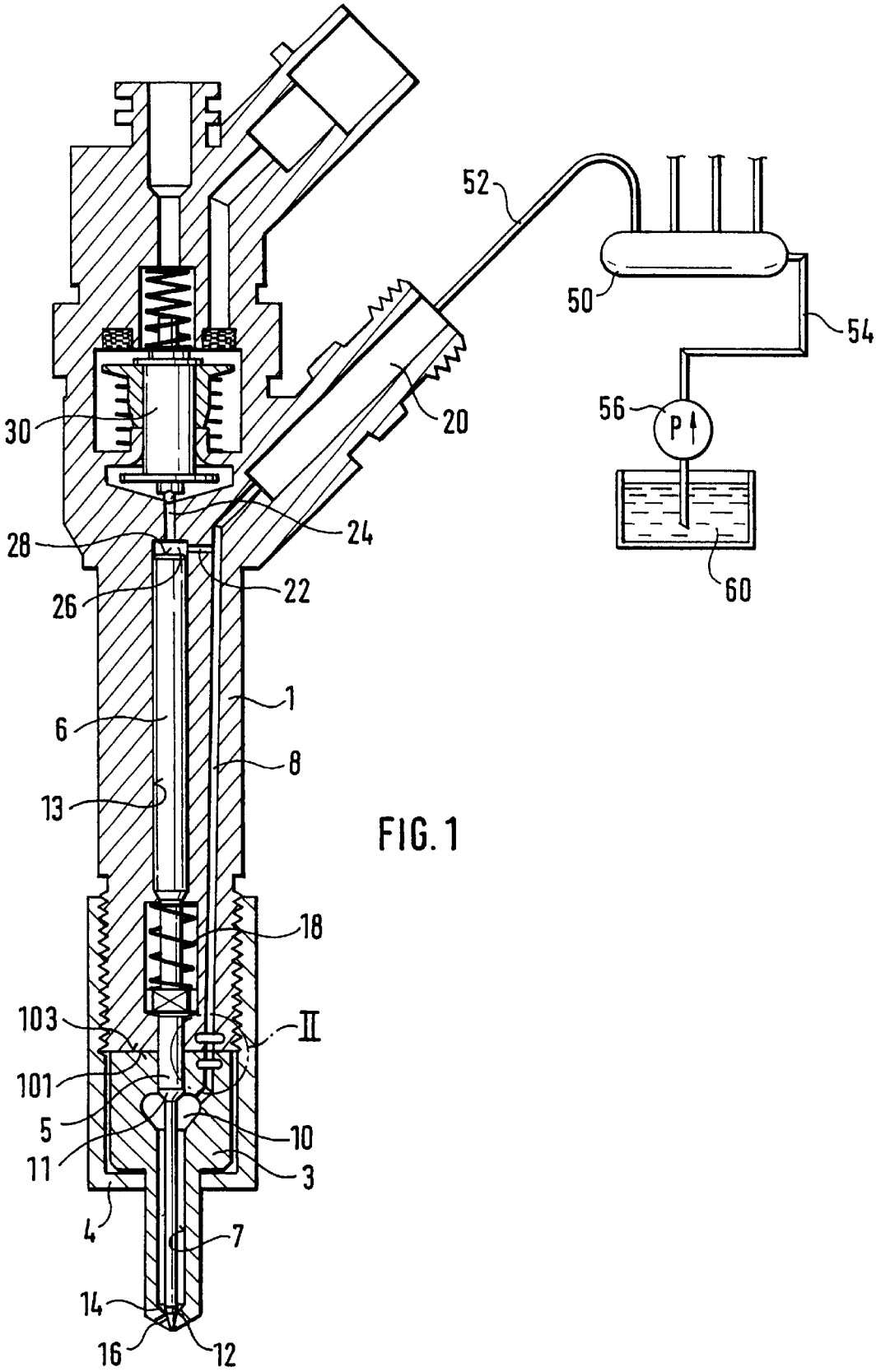
FIG. 1 is a longitudinal view of a fuel injection valve of the invention.

Referring now to the drawings, a longitudinal section through a fuel injection valve of the kind used in common rail systems is shown in FIG. 1. A valve body part, embodied as a valve body 3, is braced axially against a second valve body part, embodied as a valve retaining body 1, by means of a device embodied as a clamping nut 4. In the valve body 3, a bore 7 is embodied, on the end toward the combustion chamber of which there is at least one injection opening 16, by way of which fuel can be injected directly into the combustion chamber of an internal combustion engine. A pistonlike valve member 5 is disposed in the bore 7; it is guided in a portion of the bore 7 toward the combustion chamber and tapers toward the combustion chamber, forming a pressure shoulder 11. On the end toward the combustion chamber, a valve sealing face 12 is embodied on the valve member 5; it cooperates with a valve seat 14, embodied on the end of the bore 7 toward the combustion chamber, to control the at least one injection opening 16.

The pressure shoulder 11 is disposed in a pressure chamber 10, surrounding the valve member 5, that toward the valve seat 14 changes over into an annular conduit and extends as far as the valve seat 14. The pressure chamber 10 can be filled with fuel via an inflow conduit 8, embodied in the valve body 3 and in the valve retaining body 1, that extends from a fuel connection 20, attached laterally to the valve retaining body 1, essentially parallel to the longitudinal axis of the valve retaining body 1 and through the valve body 3, until at that point it laterally intersects the pressure chamber 10. Via a high-pressure line 52, the fuel connection 20 communicates with a high-pressure fuel chamber 50, to which fuel is supplied from a fuel tank 60 by means of a high-pressure pump 56 through an inflow line 54. In this high-pressure fuel chamber 50, a predetermined pressure level of the fuel is maintained, which is thus also the case in the inflow conduit 8 of the fuel injection valve. During the entire operation of the fuel injection valve, a high fuel pressure prevails in the inflow conduit 8, and so good sealing at the contact face of the valve body 3 and valve retaining body 1 is important for proper functioning of the fuel injection valve.

A guide bore 13, in which a pressure pin 6 is axially movable, is embodied in the retaining body 1. The pressure pin 6, with its face end toward the combustion chamber, comes to rest on the valve member 5 and with its end face 28 remote from the combustion chamber, the pressure pin defines a control chamber 26. Via an inflow throttle restriction 22, the control chamber 26 communicates with the inflow conduit 8, and it can be relieved via an outflow throttle restriction 24, which can be opened and closed by means of a magnet valve 30. Because the outflow and inflow of fuel can thus be regulated, the fuel pressure in the control chamber 26 can be controlled, and thus the force on the end face 28, remote from the combustion chamber, of the pressure pin 6 can be controlled as well.

The mode of operation of the fuel injection valve is as follows: With the fuel injection valve closed, the same fuel pressure prevails in the inflow conduit 8 and in the high-pressure fuel chamber 50 and thus in the pressure chamber 10 as well. Since at the beginning the magnet valve 30 is closed, the fuel in the control chamber 26 cannot flow out via the outflow throttle restriction 24, and so the high fuel pressure in the control chamber 26 is equivalent to the pressure in the inflow conduit 8. The result is a hydraulic force in the axial direction of the valve retaining body 1 on the end face 28 of the pressure pin 6, which face defines the control chamber 26 and is remote from the combustion chamber, and the result is that the valve member 5 is pressed via the pressure pin 6 with the valve sealing face 12 against the valve seat 14. As a result of the fuel pressure in the pressure chamber 10, there is also a hydraulic force on the pressure shoulder 11, and this force counteracts the closing force of the pressure pin 6. Since the end face 28, remote from the combustion chamber, of the pressure pin 6 has a larger area that is operative in the axial direction than the pressure shoulder 11, the hydraulic force acting in the direction of the combustion chamber on the valve member 5 predominates, causing the valve member to remain in its closing position. At the onset of the injection event, the magnet valve 30 opens the outflow throttle restriction 24 of this control chamber 26, so that the fuel can flow out of the control chamber 26. Since the outflow throttle restriction 24 has a lower flow resistance than the inflow throttle restriction 22, the fuel pressure in the control chamber 26 drops. This reduces the hydraulic force on the end face 28, remote from the combustion chamber, of the pressure pin 6 as well, until that force becomes less than the hydraulic force on the pressure shoulder 11. As a result of the hydraulic force on the pressure shoulder 11, the valve member 5 moves away from the combustion chamber and with its valve sealing face 12 lifts away from the valve seat 14. As a result, the pressure pin 6 is also moved away from the combustion chamber, until it comes, with its end face 28, into contact with the end of the guide bore 13 remote from the combustion chamber and limits the opening stroke motion of the valve member 5. Because the valve sealing face 12 lifts away from the valve seat, the at least one injection opening 16 is made to communicate with the pressure chamber 10, and fuel is injected into the combustion chamber via the injection opening 16. During the injection event, replenishing fuel flows from the high-pressure fuel chamber 50 into the pressure chamber 10, via the high-pressure line 52 and through the inflow conduit 8, so that the fuel pressure in the pressure chamber 10 remains at a high level. The end of the injection event is initiated by the closing of the outflow throttle restriction 24 by the magnet valve 30. As a result, fuel can flow into the control chamber 26 via the inflow throttle restriction 22, until the fuel pressure in the control chamber 26 has risen to the pressure in the inflow conduit 8. By the hydraulic force on the end face 28, remote from the combustion chamber, of the pressure pin 6, which now again predominates over the hydraulic force on the pressure shoulder 11, the pressure pin 6 is moved toward the combustion chamber, and thus also presses the valve member 5 with its valve sealing face 12 against the valve seat 14, and thus again closes the at least one injection opening 16.

Figure 2:
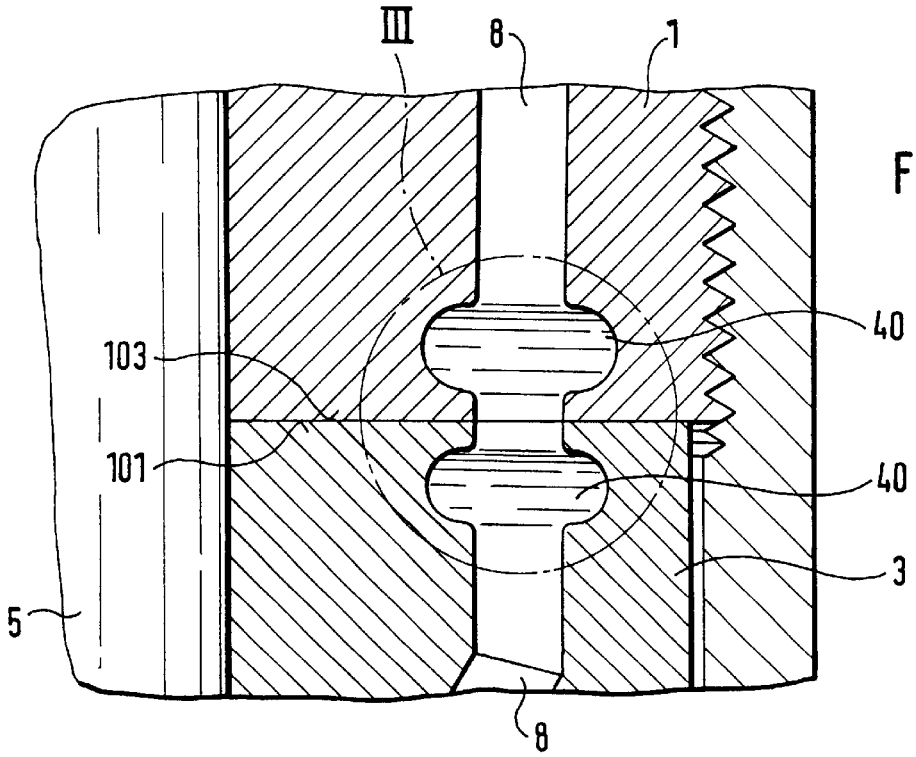
FIG. 2 is an enlarged view of the region of the passage of the inflow conduit through the contact face of the two valve body parts.
Figure 3:
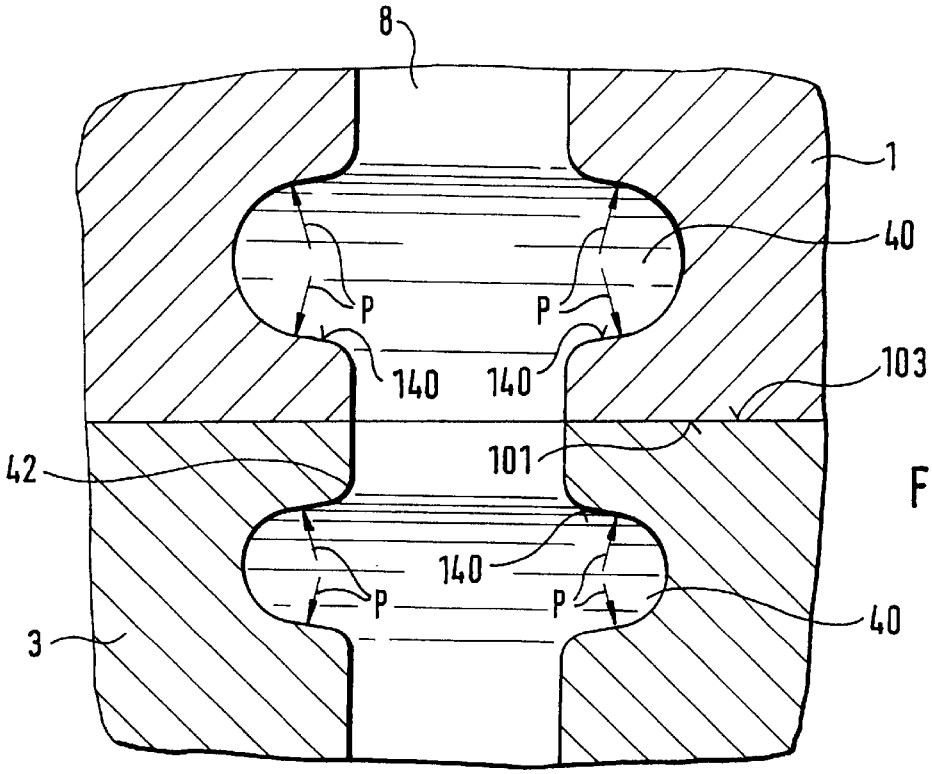
FIG. 3 shows a further enlargement of the detail, indicated in FIG. 2, in the region of the radially widened portions.

In FIG. 2, an enlargement of the fuel injection valve is shown in the region where the inflow conduit 8 passes through the contact face of the valve retaining body 1 and of the valve body 3. In the vicinity of the contact face 101 of the valve retaining body 1, but spaced apart from it, a radially widened portion 40 is embodied in the inflow conduit 8, as is also the case in the portion of the inflow conduit 8, extending within the valve body 3, near the contact face 103 of the valve body 3. By the pressure in the inflow conduit 8, force components act on the wall face of the radially widened portion 40 both in the radial direction and in the axial direction, with regard to the longitudinal axis of the inflow conduit. The forces acting in the radial direction cancel one another out because of symmetry and at most lead to a slight, technologically insignificant radial expansion of the radially widened portion 40. The forces acting in the axial direction of the inflow conduit 8, conversely, cause an expansion of the radially widened portion 40 in the axial direction. In the case of the radially widened portion 40 embodied in the valve retaining body 1, the pressure shoulder 140 oriented toward the valve body 3 is pressed in the direction of the valve body. The same happens in the valve body 3, in the radially widened portion 40 embodied there, with the pressure shoulder 140, which in this case is oriented toward the valve retaining body 1. As a result, the end face 101 of the valve retaining body 1 and the end face 103 of the valve body 3 are pressed against one another in the region of the passage of the inflow conduit 8, and the result is secure sealing of the inflow conduit 8 at the point of passage. Because of this hydraulic reinforcement of the contact force of the valve retaining body 1 and valve body 3, the force of the clamping nut 4, which causes a slight deformation of the entire fuel injection valve can be reduced. The transitions 42 of the inflow conduit 8 to the radially widened portion 40 are advantageously rounded. As a result, fewer eddies develop than if the transition had sharp edges, and the fuel can flow through the radially widened portions unhindered.

As an alternative to the fuel injection valve shown in FIG. 1, it can also be provided that the valve body 3 is braced against the valve retaining body 1 in the axial direction with the interposition of a shim. In that case, the radially widened portion according to the invention can be embodied at each passage of the inflow conduit 8 by means of a contact face of two valve body parts. It can also be advantageous that the valve retaining body 1 is constructed of a plurality valve retaining bodies, as a result of which the radially widened portion of the invention can also be embodied at the passage points of the inflow conduit 8 of these valve body parts. It can also be provided that the radially widened portion of the invention be embodied in the inflow conduit 8 of fuel injection valves that are not connected to a high-pressure fuel chamber with a predetermined pressure level. Even if the injection event is controlled via the pressure level in the inflow conduit 8, or in other words the pressure in the inflow conduit 8 is not constant during the injection event, the corresponding radially widened portion 40 results in an increased contact force in the region of the transition points of the inflow conduit 8.

It is also possible for the radially widened portion 40 of the invention to be embodied in only one valve body part. Once again, the result is an increase in the contact force in the region around the passage of the inflow conduit 8 by means of the contact face of the two valve body parts. This version is especially useful whenever one valve body part, such as a shim disposed between the valve body 3 and the valve retaining body 1, is too thin to embody the radially widened portion 40 of the invention in it.

The maximum radial extent of the radially widened portion 40 is advantageously approximately 1.5 to 2.5, and preferably approximately 2, times the diameter of the inflow conduit 8. The axial spacing of the radially widened portion 40 from the end face 101 and the end face 103 should be less than 2 mm each, in order to achieve an adequately high axial contact force.

The foregoing relates to preferred exemplary embodiment of the invention, it being understood that other variants and embodiments thereof are possible within the spirit and scope of the invention, the latter being defined by the appended claims.

I claim:

1. A fuel injection valve for internal combustion engines, comprising at least two valve body parts (1; 3), each of which, with a respective contact face (101; 103) rests on at least one other valve body part (1; 3) and are pressed against one another by a clamping means (4), and in which valve body parts (1; 3) an inflow conduit (8) is embodied, said inflow conduit passing through the contact faces (101; 103) from one valve body part (1) into the contacting valve body part (3), and the contact faces (101; 103) of the valve body parts (1; 3), in a region around where the inflow conduit (8) passes through, contact one another and thus in this region form a sealing face, and a radially widened portion formed in the portion of the inflow conduit (8) in at least one valve body part (1; 3), at a location spaced from the contact face (101; 103) of said at least one valve body part (1; 3).

2. The fuel injection valve according to claim 1, wherein the at least one radially widened portion (40) in the inflow conduit (8) is embodied at a location closely adjacent to the contact face (101; 103) of the valve body part (1; 3).

3. The fuel injection valve of claim 2, wherein the spacing of the at least one radially widened portion (40) from the contact face (101; 103) of the valve body part (1; 3) is less than 2 mm.

4. The fuel injection valve of claim 2, wherein the radially widened portion (40) is embodied as an encompassing annular groove in the inflow conduit (8).

5. The fuel injection valve of claim 4, wherein the radially widened portion (40) embodied as an annular groove has a rounded cross section.

6. The fuel injection valve of claim 2, wherein the radially widened portion (40) has a maximum diameter that is equivalent to from about 1.5 to about 2.5 times the diameter.

7. The fuel injection valve of claim 1, wherein the spacing of the at least one radially widened portion (40) from the contact face (101; 103) of the valve body part (1; 3) is less than 2 mm.

8. The fuel injection valve of claim 7, wherein the radially widened portion (40) is embodied as an encompassing annular groove in the inflow conduit (8).

9. The fuel injection valve of claim 8, wherein the radially widened portion (40) embodied as an annular groove has a rounded cross section.

10. The fuel injection valve of claim 7, wherein the radially widened portion (40) has a maximum diameter that is equivalent to from about 1.5 to about 2.5 times the diameter of the inflow conduit (8).

11. The fuel injection valve of claim 1, wherein the radially widened portion (40) is embodied as an encompassing annular groove in the inflow conduit (8).

12. The fuel injection valve of claim 11, wherein the radially widened portion (40) embodied as an annular groove has a rounded cross section.

13. The fuel injection valve of claim 12, wherein the radially widened portion (40) has a maximum diameter that is equivalent to from about 1.5 to about 2.5 times the diameter of the inflow conduit (8).

14. The fuel injection valve of claim 11, wherein the radially widened portion (40) has a maximum diameter that is equivalent to from about 1.5 to about 2.5 times the diameter of the inflow conduit (8).

15. The fuel injection valve of claim 1, wherein the radially widened portion (40) has a maximum diameter that is equivalent to from about 1.5 to about 2.5 times the diameter of the inflow conduit (8).

16. The fuel injection valve of claim 1, wherein the radially widened portion (40) has a maximum diameter of about two times the diameter of the inflow conduit (8).

* * * * *